US009685109B2

(12) United States Patent
Kimpe et al.

(10) Patent No.: US 9,685,109 B2
(45) **Date of Patent: *Jun. 20, 2017**

(54) LUMINANCE BOOST METHOD AND SYSTEM

(71) Applicant: Barco N.V., Kortijk (BE)

(72) Inventors: Tom Kimpe, Ghent (BE); Albert Xthona, Yamhill, OR (US)

(73) Assignee: Barco N.V., Kortrijk (BE)

( * ) Notice: Subject to any disclaimer, the term of this patent is extended or adjusted under 35 U.S.C. 154(b) by 103 days.

This patent is subject to a terminal disclaimer.

(21) Appl. No.: 14/731,633

(22) Filed: Jun. 5, 2015

(65) Prior Publication Data

US 2015/0269882 A1 Sep. 24, 2015

Related U.S. Application Data

(62) Division of application No. 13/704,543, filed as application No. PCT/US2011/040344 on Jun. 14, 2011, now Pat. No. 9,082,334.

(Continued)

(51) Int. Cl.
*G09G 1/00* (2006.01)
*G09G 3/3208* (2016.01)

(Continued)

(52) U.S. Cl.
CPC ..... *G09G 3/3208* (2013.01); *G09G 3/3406* (2013.01); *G09G 5/10* (2013.01);

(Continued)

(58) Field of Classification Search
CPC .. G09G 1/00; G09G 3/00; G09G 5/00; G09G 2360/16; G09G 3/3648; G09G 3/3611;

(Continued)

(56) References Cited

U.S. PATENT DOCUMENTS

2004/0155854 A1* 8/2004 Ma ..... G06F 1/3203 345/102
2009/0295841 A1* 12/2009 Park ..... G09G 3/3426 345/690

FOREIGN PATENT DOCUMENTS

EP 1 457 962 A2 9/2004

OTHER PUBLICATIONS

International Search Report and Written Opinion for corresponding International Application No. PCT/US2011/040344 mailed Jun. 14, 2011.

(Continued)

*Primary Examiner* — Michael Faragalla
(74) *Attorney, Agent, or Firm* — Grant J Steyer

(57) ABSTRACT

A system and method for increasing perceived contrast in a medical display (174) is provided. The method involves temporarily increasing luminance output of at least part of a display (174) in response to a received request for improved visualization. To compensate for the change in luminance especially while the viewer's eyes adapt to the change in luminance, the method includes continuously modifying the display parameters especially during an adaptation period to match an adaptation of the viewer's eyes. The modified parameters at any given may correlate to the degree of adaptation by the viewer's eyes to the change. After a period of time, the display (174) may be returned to its normal operating luminance and corresponding settings, which may be selected to maximize the lifetime of the display (174).

17 Claims, 10 Drawing Sheets

Related U.S. Application Data

(60) Provisional application No. 61/354,313, filed on Jun. 14, 2010.

(51) Int. Cl.
*G09G 3/34* (2006.01)
*G09G 5/10* (2006.01)

(52) U.S. Cl.
CPC ..... *G09G 2320/0233* (2013.01); *G09G 2320/0276* (2013.01); *G09G 2320/041* (2013.01); *G09G 2320/043* (2013.01); *G09G 2320/066* (2013.01); *G09G 2320/0613* (2013.01); *G09G 2320/0626* (2013.01); *G09G 2320/0653* (2013.01); *G09G 2320/0673* (2013.01); *G09G 2320/0693* (2013.01); *G09G 2330/022* (2013.01)

(58) Field of Classification Search
CPC ... G09G 2320/0271; G09G 2320/0233; G09G 2320/0626; G06F 1/00; G06F 3/1446; G06F 3/1454
See application file for complete search history.

(56) References Cited

OTHER PUBLICATIONS

International Preliminary Report on Patentability for corresponding International Application No. PCT/US2011/040344 mailed Aug. 3, 2012.

* cited by examiner

LUMINANCE BOOST METHOD AND SYSTEM

RELATED APPLICATION

This application is a division of U.S. application Ser. No. 13/704,543 filed Mar. 11, 2013, which claims the benefit of International Application No. PCT/US2011/040344 filed Jun. 14, 2011, which claims the benefit of U.S. Provisional Application No. 61/354,313 filed Jun. 14, 2010, all of the aforesaid applications are hereby incorporated herein by reference.

FIELD OF THE INVENTION

The present invention relates generally to image display devices, and particularly to methods and systems for adjusting the luminance of image display devices.

BACKGROUND

When using imaging devices for diagnostic purposes, clinicians often are looking for very subtle image features that can indicate the presence of disease. It is well known that brighter displays provide clinicians with the ability to see more subtle features as compared to darker displays having the same physical contrast. It is for this reason that medical displays in particular are typically designed to be as bright as possible.

Of course, it is also well known that higher luminance results in higher heat levels which speeds up degradation and decreases efficiency. And increasing the current (drive level) sent through the display or the backlight of the display, increases the rate of degradation. This is particularly true of transmissive displays, e.g., LED, OLED, EL, or CCFL, which utilize backlights. A backlight that is driven to produce maximum luminance output all of the time will degrade much more quickly compared to the same backlight that is driven at a lower value. Moreover, it is preferable for any display to be consistent over time, i.e. display the same image at the beginning and at the end of its lifetime. If the luminance setting is near maximum, the output luminance of that display will gradually reduce over time (as will the detectability of subtle features).

SUMMARY OF THE INVENTION

The present invention provides a system and method for improving the visibility of subtle image differences. The system and method provide two operating modes of a display, these being a normal mode and a boost mode. In the normal mode the display is configured to have a normal luminance level such that there is a good compromise between display lifetime and detectability of subtle features. For transmissive displays that use backlights, lifetime of the display is often limited by the display backlight lifetime. In case of emissive displays, display lifetime if often limited by the lifetime of the active emitting material (e.g., OLED material). In the boost mode, the display is for a short period of time set to a much higher luminance level such that subtle features can more easily be detected. For example, the luminance of the backlight is modified in case of transmissive displays and the luminance of the active emissive material is modified in the case of emissive displays.

The user of the display can move from normal mode to boost mode by any suitable means, such as by pushing a button on the front of the display. Alternatively, a software application can (manually or automatically) instruct the display to move from normal mode to boost mode as well. When the boost mode actuated, the display automatically increases its luminance level to a higher level (quickly or gradually), adapts the calibration data such that it matches the adaptation of the human eye to the change in luminance. For example, the calibration may be modified so that the display remains compliant with a governing standard. In the case of gray scale medical displays, for example, the display may maintain compliance with the DICOM GSDF standard. Moreover, the display may keep adapting its calibration data continuously to take into account the continuous adaptation process of the human eye.

Provision also may be made for monitoring one or more parameters of the display, such as backlight status (e.g. temperature). Subsequently, the display may return its normal mode of operation either through user action or more preferably automatically. For example, the display may return to normal mode after a specified period of time has elapsed or when backlight temperature exceeds a predetermined threshold value.

To facilitate adaptation of the human eye, the display may gradually change its luminance level from a first luminance level to a second luminance level instead of instantly. For example, the luminance may be modified according to a sigmoid function, such as by using the following equation:

$$y=s/[1+e^{(-x/a)}]$$

where "y" is the change in luminance as a function of time, which may then be used to determine the backlight drive value in function of time; "s" is the step size in luminance ($cd/m^2$) when activating the boost mode; "a" is a parameter that determines the steepness of sigmoid function, which may be selected based on duration of the transition period; and "x" is time in milliseconds, which may range, for example, from −2500 up to +2500 milliseconds when the transition period is 5 seconds.

During this gradual increase of luminance the display may continuously adapt its calibration data continuously to remain compliant with a governing standard, such as maintaining the display DICOM GSDF compliant, while accounting for the adaptation process of the human eye. Similarly, the display may also gradually change its luminance level back from the second luminance level to the first luminance level instead of instantly. Like during the luminance increase, during this gradual decrease of luminance the display may continuously adapt its calibration data continuously to remain compliant with a governing standard, such as maintaining the display DICOM GSDF compliant, while accounting for the adaptation process of the human eye.

The system and method, depending on its particular implementation, can overcome one or more problems associated with prior art systems. Lifetime can be maximized while at the same time maximizing detectability. Additionally or alternatively, the problems of eye adaptation correct medical calibration can be solved.

Accordingly, invention provides a method for improving visualization in a medical display. The method includes operating the display at a normal luminance setting; receiving a request for improved visualization; modifying the luminance of the display to cause the display to operate in a boost mode luminance setting that is higher than the normal luminance setting; and automatically returning the display to the normal luminance setting.

The return of the display to the normal luminance may be triggered by at least one of: an elapsed period of time, or an increase in backlight or display temperature that exceeds an absolute or relative threshold, or an explicit instruction of the user or viewing software that the boost mode is no longer needed, or the cessation of an indicator that the display should continue to operate in the boost mode, e.g., a viewer or software program ceases to interact with the system, such as by releasing a kill switch.

The invention also provides a method for increasing perceived contrast in a medical display. The method may include receiving a request for improved visualization of the display operating at a first luminance setting with initial display parameters. The first luminance setting may be, for example, the normal luminance setting of the display. The method further includes increasing the luminance of at least part of the display from the first luminance setting to a second luminance setting, which may be referred to as a boost mode; modifying the display parameters to correspond to the increased luminance such that the perceived difference in luminance between adjacent video levels (i.e., the perceived contrast between adjacent video levels) at the second luminance setting is greater than the perceived difference in luminance between adjacent levels at the first luminance setting; and continuously modifying the display parameters during an adaptation period to match an adaptation of a human eye to the change in luminance from the first luminance setting to the second luminance setting. Matching an adaptation of a human eye to the change in luminance from the first luminance setting to the second luminance setting may be achieved by altering the display parameters (e.g., calibration data) continuously such that the human eye continuously perceives the display to be perceptually linearized.

The method may further include returning the display to the first luminance setting; continuously modifying the display parameters during an adaptation period to match an adaptation of a human eye to the change in luminance from the second luminance setting to the first luminance setting; and returning the display parameters to the initial display parameters. The display may be returned to the first luminance setting after a predetermined or calculated time period, manually or automatically. The time period may be defined, for example, from the point at which the luminance was originally increased, or for example from the difference in the first and second luminance levels, or for example from the point at which the human eye is fully adapted to the change in luminance (i.e., from the time it takes the human eye to fully or partially adapt to the difference in luminance level). In addition, the method may further include receiving a request to maintain the display at the second luminance setting. For example, a viewer of the display or a software application may be capable of controlling the duration of the increased luminance for example based on the type of image that is being displayed or based on the task that the user needs to perform or based on personal user preferences.

According to another aspect of the invention, the display settings are DICOM GSDF compliant at the first luminance setting, at the second luminance setting and during the adaptation period. In addition, the video content that is sent to the display panel may be modified following receipt of a request for improved visualization and prior to or at the moment of increasing the luminance of the display. For example, if the maximum video level of the display is 255 and the display is set to a lower level, such as 199, at the time the request for improved visualization is received, the video level may be increased (e.g., by way of contrast enhancement and adjusting other display parameters as will be understood by those skilled in the art) prior to increasing the luminance of the display. Thus, if a display shows an image that does not make use of the entire dynamic range that the display offers (e.g., the image sent to the display panel only contains gray levels 54 up to 220) then the image data can be modified such that the entire dynamic range of the display is used. This further improves visualization of the image.

Alternatively, the contrast enhancement may modify the image data such that the lowest video level in the image stays does not change (e.g., it stays video level 54) but that all other levels are rescaled such that the highest video level becomes the maximum video level that the display can handle (e.g., level 220 is mapped onto level 255 in case of an 8 bit display, and all original video levels with range 54-220 are mapped onto the range 54-255). The example given is only illustrative and the person skilled in the art will understand that various types of contrast enhancement, histogram mapping and gamut mapping algorithms can be used. In an alternative implementation, the modification of the image contents could also be done gradually instead of instantly in order to facilitate adaptation of the human eye. Moreover, both techniques may be combined. Thus it is possible and may be desirable to concurrently apply modification of the image data (to maximally make use of the available dynamic range of the display) while increasing the luminance and adapting corresponding display parameters (e.g., to ensure that the display remains DICOM GSDF compliant).

Following the change in luminance, the display parameters may be modified according to, for example, an algorithm, a look up table ("LUT") or using any other known model suitable for compensating for a change in luminance.

The second luminance setting may be determined based one or more of a variety of factors. For example, it may be determined based on the maximum achievable luminance level of the display. In such instance, it may be preset. In addition, it may also be determined based on one or more factors such as the desired amount of increased detectability, the type of medical image being viewed or type of task to be performed, the currently maximum achievable luminance of the display, the remaining expected lifetime of the display, the temperature of display elements prior to increasing the luminance, the ambient light level, or the time required for the human eye to adapt to the change in luminance. In addition, the method may further include monitoring the temperature of the at least one backlight while the display is operating at the second luminance setting to prevent the display from operating outside acceptable parameters.

The method may also provide a viewer with the ability to further increase luminance of the display. Accordingly, the method may further include receiving a request for improved visualization of the display operating at a second luminance setting with modified display parameters; increasing the luminance of at least part of the display from the second luminance setting to a third luminance setting; modifying the display parameters to correspond to the increased luminance such that the perceived difference in luminance between adjacent levels at the third luminance setting is greater than the perceived difference in luminance between adjacent levels at the second luminance setting; and continuously modifying the display parameters during an adaptation period to match an adaptation of a human eye to the change in luminance from the second luminance setting to the third luminance setting.

In addition, the display may include multiple backlights, and increasing the luminance of the display may include at least one of: increasing the luminance of at least one backlight operating at the first luminance setting, or activating at least one additional backlight. Also, the luminance may be increased over only part of the display. The method may include receiving information identifying a target area of the display and increasing the luminance of the display to a second luminance setting only over the identified target area. The process of continuously modifying the display parameters also may involve modifying the display parameters at the refresh rate of the display and may be synchronized to the refresh of the display.

According to another aspect of the invention there is provided a medical image display system. The medical image display system may include: a display; an image processing controller communicably coupled to the display; and memory communicably coupled to the image processing controller. The controller may be configured to perform each of the functions identified above with respect to method for increasing perceived contrast in a medical display.

The features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope.

Features that are described and/or illustrated with respect to one embodiment may be used in the same way or in a similar way in one or more other embodiments and/or in combination with or instead of the features of the other embodiments.

DETAILED DESCRIPTION

Figure 1:
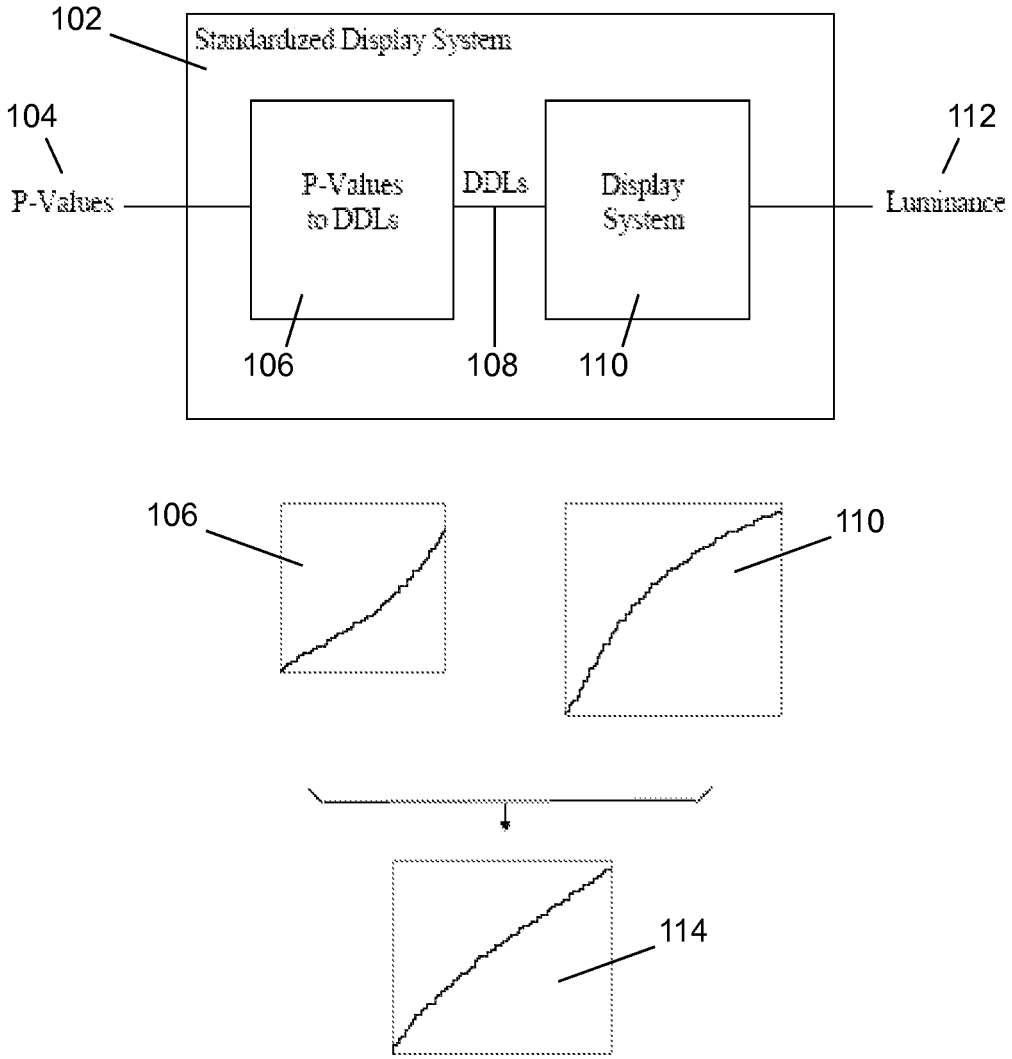
FIG. 1 is a graphical representation of the conceptual model of a conventional standardized display system that matches P-values to Luminance via an intermediate transformation to digital driving levels of a non-standardized display system.

The present invention relates to a system and method providing the viewer with an increased ability to perceive subtleties in the displayed image without dramatically decreasing the lifetime of the display as would occur if the display were permanently set at a high luminance level.

For example, medical displays may need to achieve lifetimes (time to half of initial peak luminance) of 50,000 hours and more. To achieve such long lifetime, medical displays may be set to a luminance output much lower than the initially maximum achievable level. Consequently, clinicians are diagnosing patients using displays operating at less than maximum luminance. This makes it more difficult for those clinicians to see subtle differences in images and, thus, making a diagnosis takes more time and it is more difficult to determine the correct diagnosis for their patients.

As used herein, the term "display" is not intended to be limited to any particular types of displays, and includes such things as cathode ray tube devices, projectors, and any other apparatus or device that is capable of displaying an image for viewing.

To provide improved visualization, there is a method for temporarily increasing the luminance setting of the display from a normal mode to a boost mode upon receipt of a request for improved visualization. The method includes increasing the luminance output of the display and modifying display parameters to correspond to the increased luminance such that the difference in luminance between adjacent levels at the second luminance setting is greater than the difference in luminance between adjacent levels at the first luminance setting so that the system provides the viewer with essentially the same perceived contrast immediately after the luminance is increased even though the viewer's eyes have not yet adapted to the increase in luminance.

The method further includes continuously modifying the display parameters during an adaptation period to match an adaptation of a human eye to the change in luminance from the first luminance setting to the second luminance setting. In this manner, the image is continuously adjusted until the viewer's eye is fully adapted.

The method may further include returning the display to its original luminance after a period of time or upon receipt of a command for the display to return to its normal operating mode.

The present invention is particularly applicable to medical displays because there are several guidelines that have been developed for calibration of such displays to help ensure consistency for diagnostic purposes. The American College of Radiology (ACR) and National Electrical Manufacturers Association (NEMA) formed a joint committee to develop a Standard for Digital Imaging and Communications in Medicine (DICOM). In doing so, the committee also developed the Grayscale Standard Display Function ("GSDF"). The DICOM GSDF defines a method for taking the existing Characteristic Curve of a display system (i.e. the Luminance Output in function of each Digital Driving Level ("DDL") or pixel value) and modifying it to the GSDF.

At the heart of the GSDF is the Barten Model, which addresses the perceptivity of the human eye and the adaptation period required for the human eye to adjust to changes in display parameters such as luminance. According to the GSDF, given the black and white levels of the display system, a properly calibrated display should spread out the luminance at each of the intermediary DDLs such as to maximize the Just Noticeable Differences ("JND") between each level. A JND is the luminance difference that a standard human observer can just perceive. Calibration has the aim that each DDL will be as distinguishable as possible from neighboring levels, throughout the luminance range, and it will be consistent with other display systems that are similarly calibrated.

A part of DICOM, supplement 28 ("Digital Imaging and Communications in Medicine (DICOM) *Supplement* 28*: Grayscale Standard Display Function*," available at http://medical.nema.org/dicom/final/sup28_ft.pdf) describes the GSDF in more detail, the entirety of which is incorporated herein by reference. The DICOM supplement provides a formula based on human perception of luminance and is also published as a table (going up to 4000 cd/m2). It also uses linear perceptions and JND.

Figure 2:
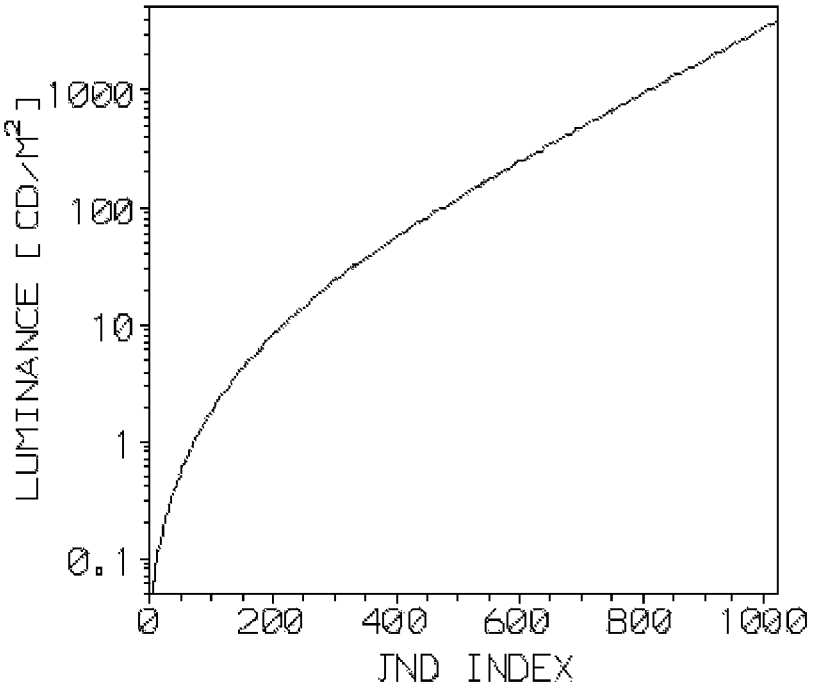
FIG. 2 is a graphical representation of the prior art Grayscale Standard Display Function presented as logarithm of Luminance versus Just Noticeable Difference index.

FIGS. 1 and 2 are extracted from the DICOM supplement 28 document. FIG. 1 shows the principle of changing the global transfer curve of a display system to obtain a standardized display system 102 according to a standardized grayscale standard display function. In other words, the input-values 104, referred to as P-values 104, are converted by means of a "P-values to DDLs" conversion curve 106 to digital driving values or levels 108, referred to as DDL 108, in such a way that, after a subsequent "DDLs to luminance" conversion, the resulting curve "luminance versus P-values" 114 follows a specific standardized curve. The digital driving levels then are converted by a "DDLs to luminance" conversion curve 110 specific to the display system (native transfer curve of the display system) and thus allow a certain luminance output 112. This standardized luminance output curve is shown in FIG. 2, which is a combination of the "P-values to DDLs" conversion curve 106 and the "DDLs to luminance" curve 110. This curve is based on the human contrast sensitivity as described by the Barten's model. It is to be noted that it is clearly non-linear within the luminance range of medical displays. The GSDF is defined for the luminance range 0.05 cd/m$^2$ up to 4000 cd/m$^2$. The horizontal axis of FIG. 2 shows the index of the JNDs, referred to as luminance JND, and the vertical axis shows the corresponding luminance values. A luminance JND represents the smallest variation in luminance value that can be perceived at a specific luminance level. A more detailed description can be found in the DICOM supplement 28 document.

A display system that is perfectly calibrated based on the DICOM grayscale standard display function will translate its P-values 104 into luminance values (cd/m$^2$) 112 that are located on the GSDF and there will be an equal distance in luminance JND-indices between the individual luminance values 112 corresponding with P-values 104. This means that the display system will be perceptually linear: equal differences in P-values 104 will result in the same level of perceptibility at all digital driving-levels 108. Of course, in practice the calibration is often not perfect due to the fact that typical systems utilize only a discrete number of output luminance values (for instance 1024 specific grayscales).

Figure 3:
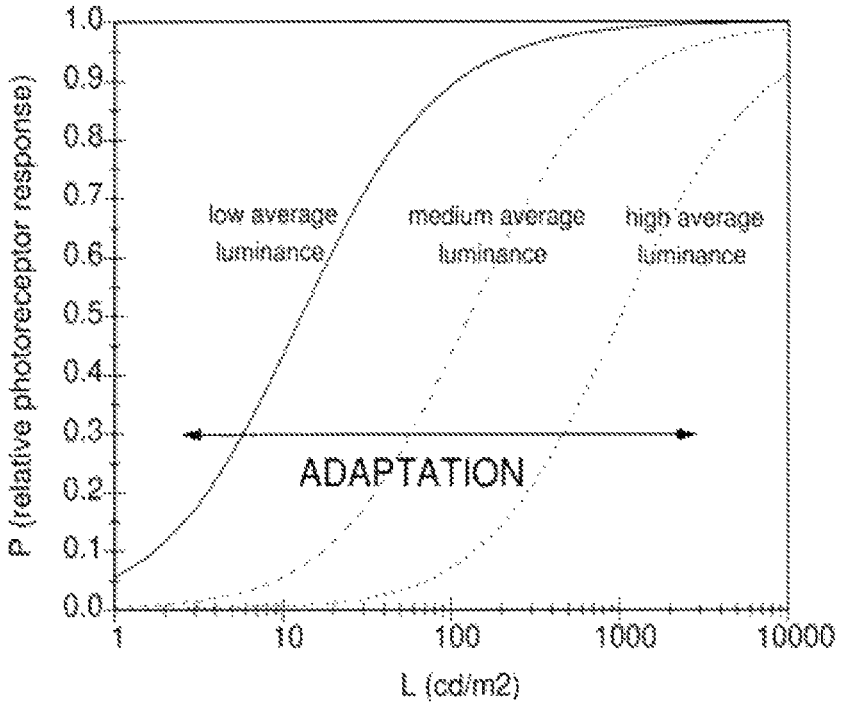
FIG. 3 is a graphical representation of sample retinal response curves at different adapted luminance levels.

FIG. 3 is a graphical representation of sample retinal response curves at different adapted luminance levels. The greater the retinal response, the greater the required adaptation time. This adaptation time can range from seconds (rather small luminance differences) to up to almost minutes in case of very large luminance differences. The present invention is aimed at eliminating the non-productive time that would otherwise result from the retinal adaptation time required to adjust to a change in luminance. Another advantage of eliminating the non-productive time is that following an increase in luminance, the display is operating at a high output level, which tends to cause faster degradation. The less time the display operates at a high luminance, the longer the display is likely to last.

Figure 4:
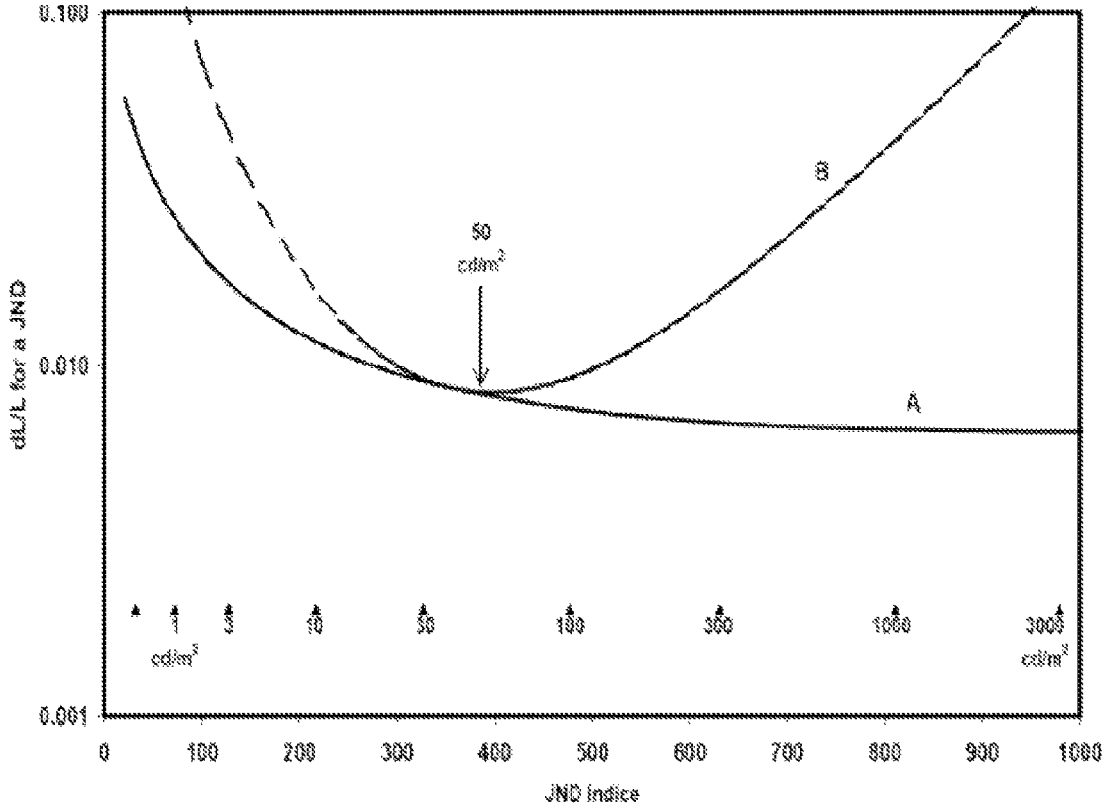
FIG. 4 is a graphical representation of sample contrast thresholds for fixed and variable retinal adaptation.

FIG. 4 is a graphical representation of sample contrast thresholds for fixed and variable retinal adaptation. FIG. 4 illustrates the required contrast difference between consecutive gray levels to be compliant with DICOM GSDF in case of variable adaptation (curve A, the eye is given time to adapt to the current (average) image level) and fixed adaptation (curve B, the eye was adapted to 50 cd/m$^2$ and then suddenly the luminance was increased). The two curves illustrate that if the human eye is not given time to adapt, the difference in luminance between consecutive gray levels must to be increased in order to achieve the same perceived contrast between consecutive gray levels.

When the luminance of the display is stable for a long time, then the eye will be fully adapted and the calibration curve of the display may follow, for example, the normal DICOM GSDF curve, which is represented by curve A of FIG. 4. If, however, the average luminance of the display suddenly changes (such as contemplated by the present invention) the viewer's eye, then the eye will still be adapted to the original luminance. Accordingly, the difference in luminance between consecutive gray levels must to be increased in order to achieve the same perceived contrast between consecutive gray levels. Thus, the calibration curve may be adapted to follow the curve B. The exact curve to be followed at any moment in time should reflect the exact adaptation point of the human eye, which can be calculated based on a human visual system model, or determined by means of experiments as will be understood by those of skill in the art. Thus, at any moment in time the display may still be DICOM compliant in an adapted calibration state.

As the viewer's eye adapts to the change in luminance, for example, from an average luminance of 50 cd/m$^2$ to an average luminance of 200 cd/m$^2$, the actual calibration curve may gradually move from curve B towards curve A. When the eye is fully adapted to the increased luminance, the display may once again be calibrated to the normal DICOM GSDF curve, represented by curve A. Of course, the display may have modified calibration values, such as higher JND values, because GSDF defines calibration in function of absolute luminance values.

Those of ordinary skill in the art will understand that a gradual change in luminance may be implemented in a variety of ways. In one such implementation, the luminance may be modified according to a sigmoid function, such as by using the following equation:

$$y=s/[1+e^{(-x/a)}]$$

where "y" is the change in luminance as a function of time, which may then be used to determine the backlight drive value in function of time; "s" is the step size in luminance (cd/m$^2$) when activating the boost mode; "a" is a parameter that determines the steepness of sigmoid function, which may be selected based on duration of the transition period; and "x" is time in milliseconds, which may range, for example, from −2500 up to +2500 milliseconds when the transition period is 5 seconds.

Turning next to FIGS. 5A-J, provided is an example of how the calibration data of a display can be adapted when switching the display from a first luminance setting to a second luminance setting, taking into account that after the switch to the second luminance setting the human eye requires time to adapt to the luminance change. Of course, it will be understood by those of skill in the art that the calibration curves of FIG. 5 are exemplary only and that other curves may be used.

In this specific example, the display may be an OLED display, which is an emissive display, meaning that the luminance emitted by a pixel is dependent to the current that is driven through the pixel. The first luminance setting is such that video level 0 (minimum) corresponds to 1 cd/m$^2$ and video level 255 (maximum) corresponds to 300 cd/m$^2$; and the second luminance setting is such that the that video level 0 (minimum) corresponds to 1 cd/m$^2$ and video level 255 (maximum) corresponds to 2000 cd/m$^2$. Thus, the contrast ratio for the first luminance setting is 300:1 and the contrast ratio for the second luminance setting is 2000:1. For simplicity, this example assumes that the display has been operating at a first luminance setting long enough for human eyes to be perfectly adapted to the average luminance of the display, which may be, for example, 50 cd/m$^2$. Of course, the average luminance of the display may depend on the image contents being displayed.

Figure 5A:
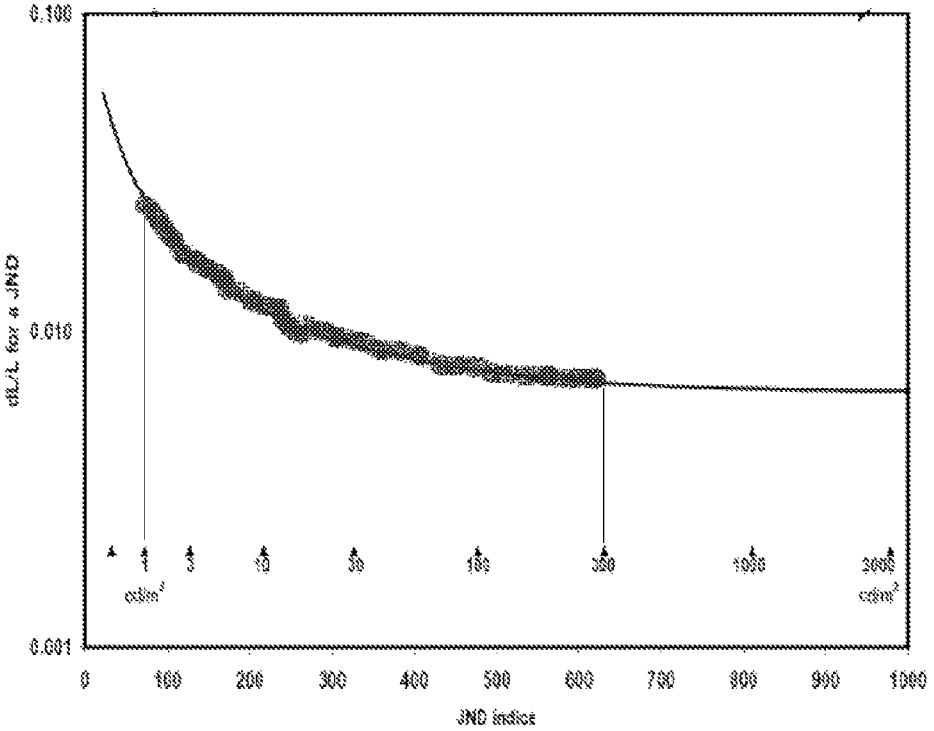
FIGS. 5A-J are exemplary calibration curves according to the invention for a display in which the luminance is increased.
Figure 5B:
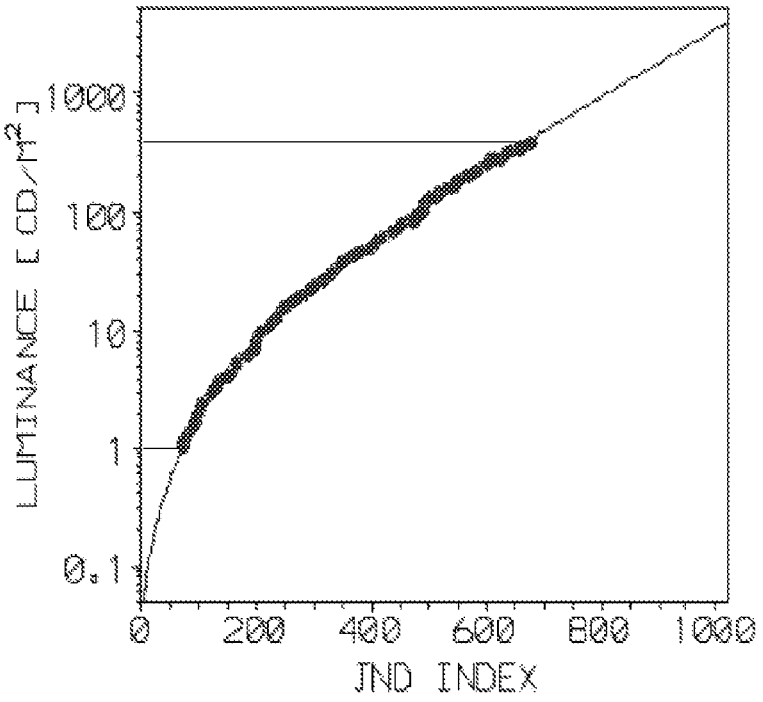

For medical images, for example, typical image contents correspond to average video levels of 15-30%. In a medical environment, it may be preferable if the display complies with the DICOM GSDF standard, which assumes that the eye is perfectly adapted to the luminance of the display. The compliant calibrated display will follow the curves illustrated as FIGS. 5A and 5B, which are two different ways of visualizing the same calibration state of the display. FIGS. 5A and 5B illustrate curves defined by a minimum display luminance level of 1 cd/m$^2$ and a maximum display luminance level of 300 cd/m$^2$).

The system may then receive a request to increase the display from the first luminance setting to a second luminance setting, which may involve, for example, increasing the maximum current through the display pixels such that video level 0 (minimum) corresponds to 1 cd/m$^2$ and video level 255 (maximum) corresponds to 2000 cd/m$^2$, yielding a contrast ratio of 2000:1. The DICOM GSDF standard requires that displays follow a particular luminance curve (the GSDF curve illustrated in FIG. 5C) and the exact part of the curve that needs to be followed depends on the minimum and maximum luminance levels of the display (in this particular example, 1 cd/m$^2$ and 2000 cd/m$^2$). Since these luminance levels have changed, the display instantly after adapting its luminance range may adapt the calibration data such that again in order to compensate for the luminance change so that the display remains compliant with the DICOM GSDF standard.

Figure 5C:
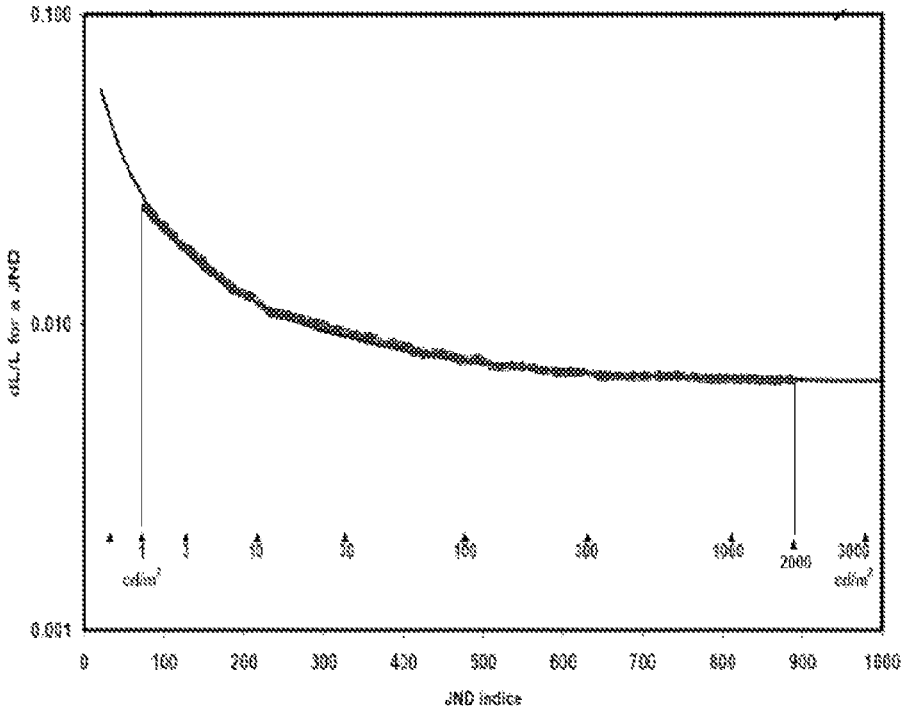
Figure 5D:
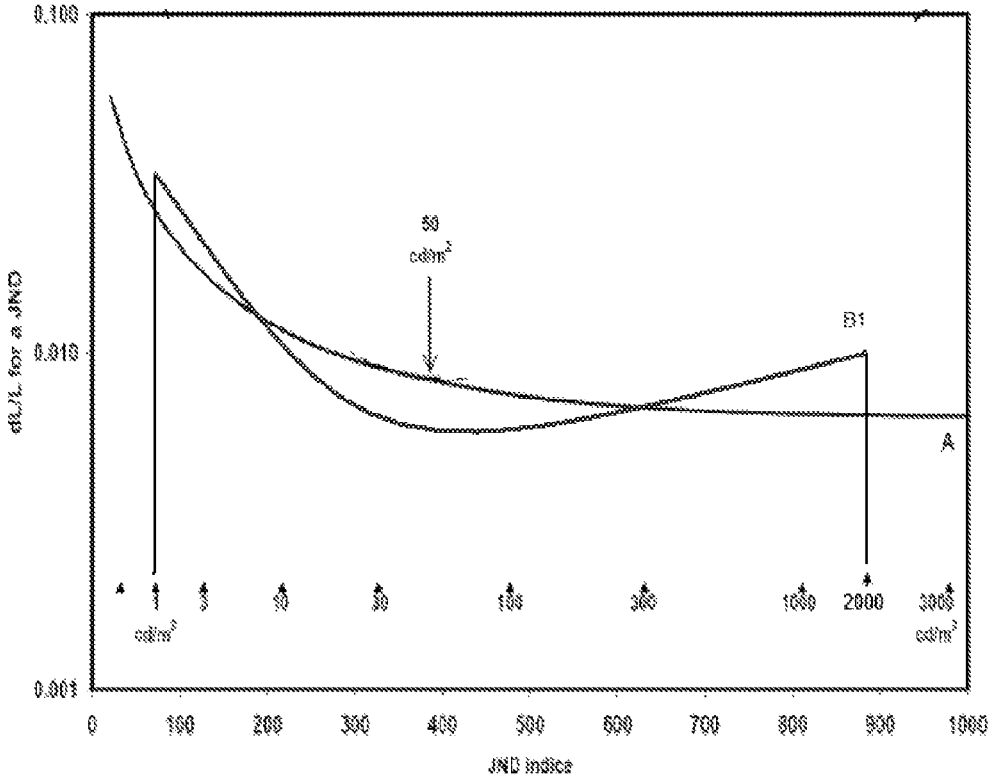
Figure 5E:
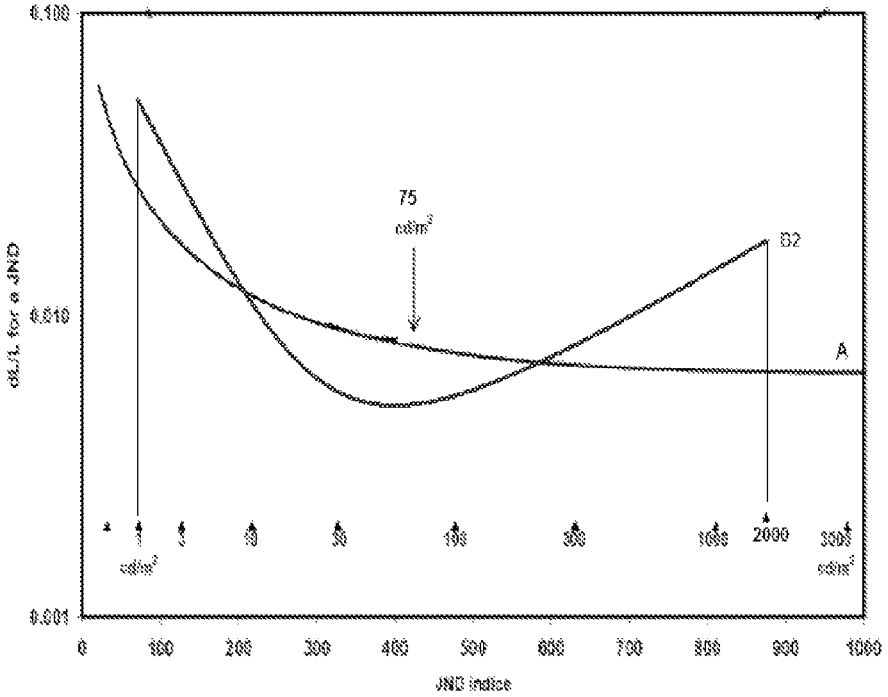
Figure 5F:
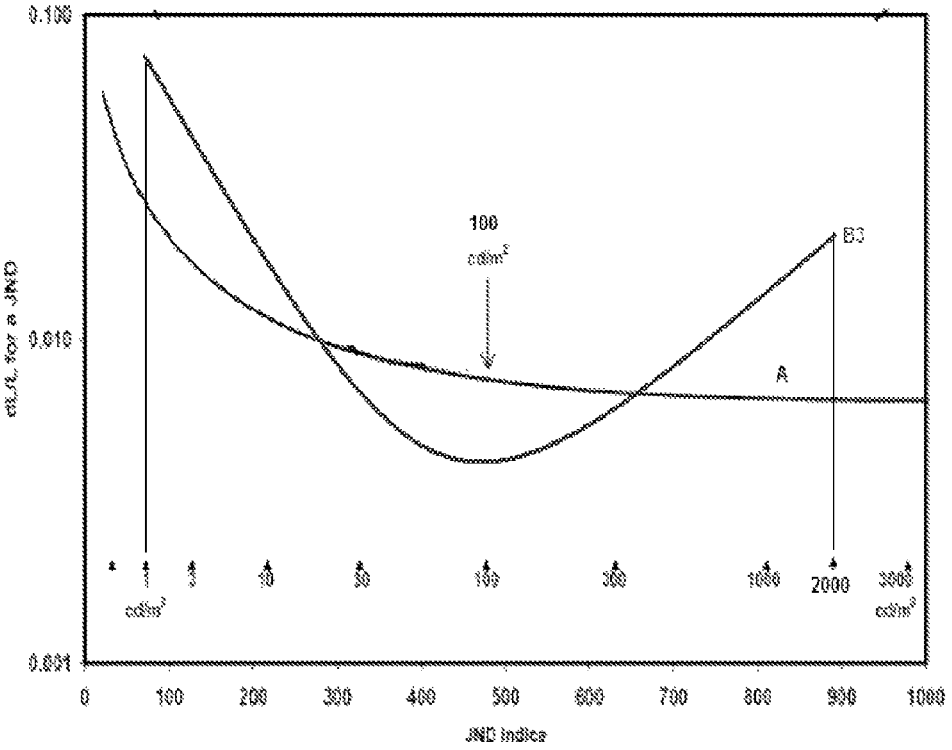
Figure 5G:
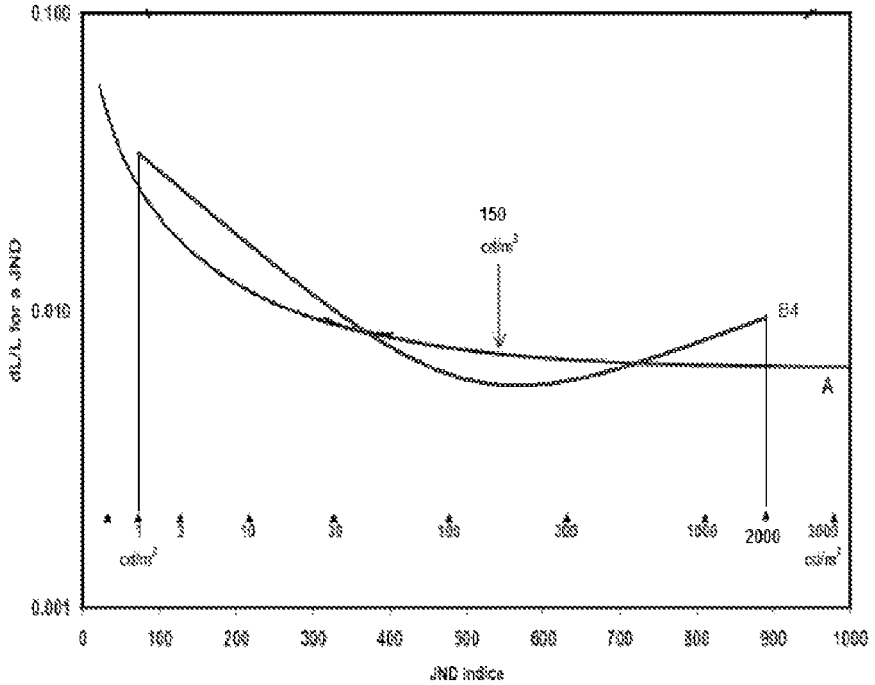
Figure 5H:
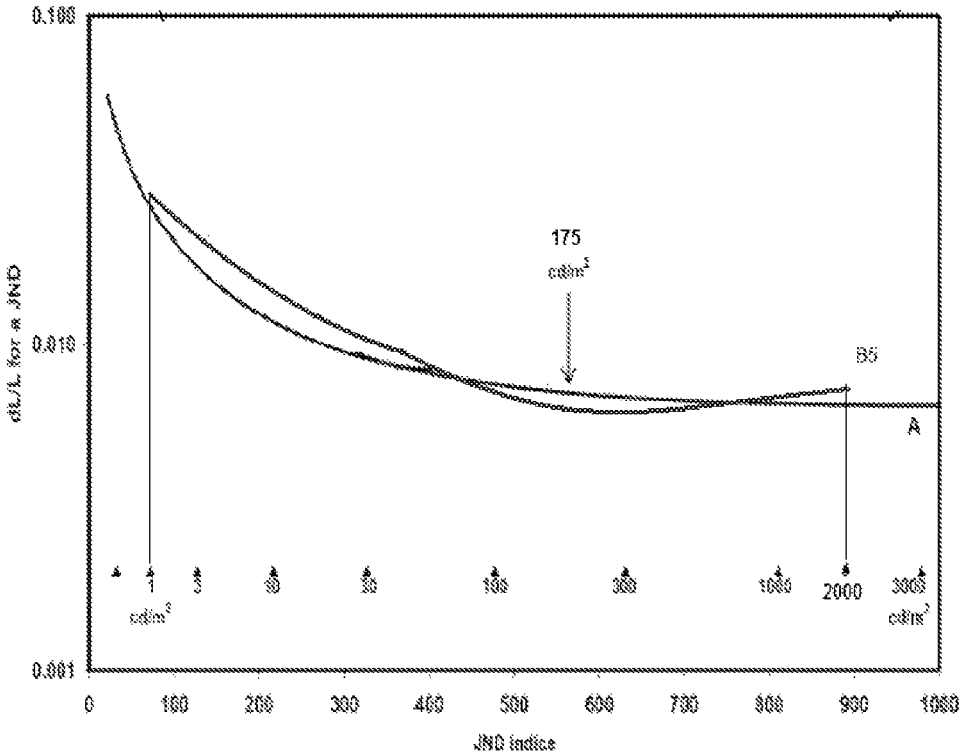

The DICOM GSDF curve of FIG. 5C assumes that the human eye is perfectly adapted immediately to the new boost mode luminance range. In practice this may not be the case, the human eye will require an adaptation period that is dependent on the change in luminance. During the adaptation period the display will not be perceived by the viewer as perceptually uniform (which is the goal of the DICOM GSDF standard). Accordingly, the system may compensate for the fact that the human eye is not yet adapted and modify display parameters so the display is calibrated not to the DICOM GSDF curve of FIG. 5C, but to a modified curve that factors in the human eye's continuous adaptation to the change in the luminance. An exemplary modified calibration curve assuming the eye is adapted at a luminance level of 50 cd/m$^2$ is illustrated in FIG. 5D.

As the eye adapts, the display may adapt its calibration curve to correspond to the adaptation of the eye. For example, FIGS. 5E through 5H illustrate a series of exemplary calibration curves that may match an eye adapted at luminance levels 75 cd/m$^2$, 100 cd/m$^2$, 150 cd/m$^2$, 175 cd/m$^2$, respectively.

Figure 5I:
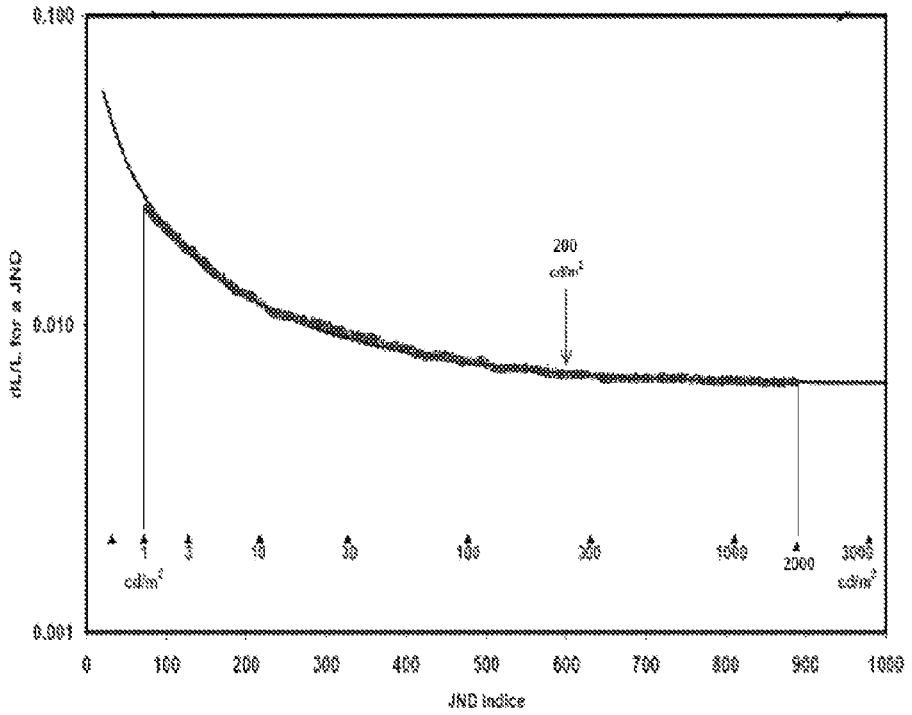
Figure 5J:
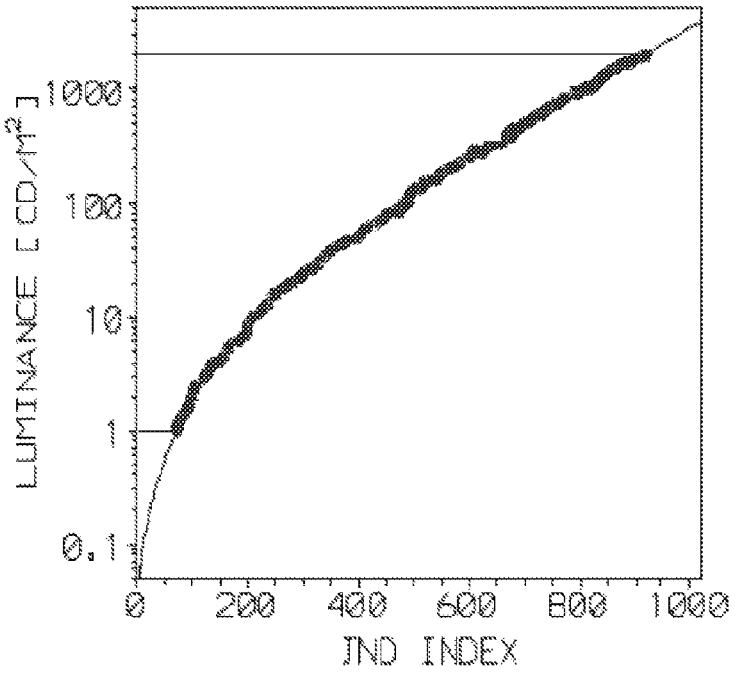

When the eye is (almost) adapted to the new average luminance of the second luminance setting, the display again may have a normal DICOM GSDF calibration curve that corresponds to the second luminance level of the display as illustrated in FIGS. 5I and 5J. Note that in this example the average luminance (averaged over display area) when the display is operating at the second luminance setting is assumed to be 200 cd/m$^2$. In the figure below it can be seen that the user's eye is adapted to 200 cd/m$^2$ and therefore the calibration data of the display again corresponds to a normal DICOM GSDF curve with minimum luminance 1 cd/m$^2$ and maximum luminance 2000 cd/m$^2$.

When the display moves back from the second luminance setting to the first luminance setting, a similar series of actions may be taken. Thus, the display may continuously update its calibration data such that at any moment in time the calibration of the display reflects the actual adaptation state of the eye of the user. While doing that, again the calibration curve may gradually change from the DICOM GSDF curve that corresponds to second luminance setting, over a series of curves that take into account the fact that the user's eye is not yet adapted to the first luminance setting, and eventually the calibration data from the display will be back at DICOM GSDF curve corresponding to the first luminance setting. The return to the DICOM GSDF curve may occur when the user's eye is adapted (or almost adapted) to the average luminance of the display at the first luminance setting.

Figure 6:
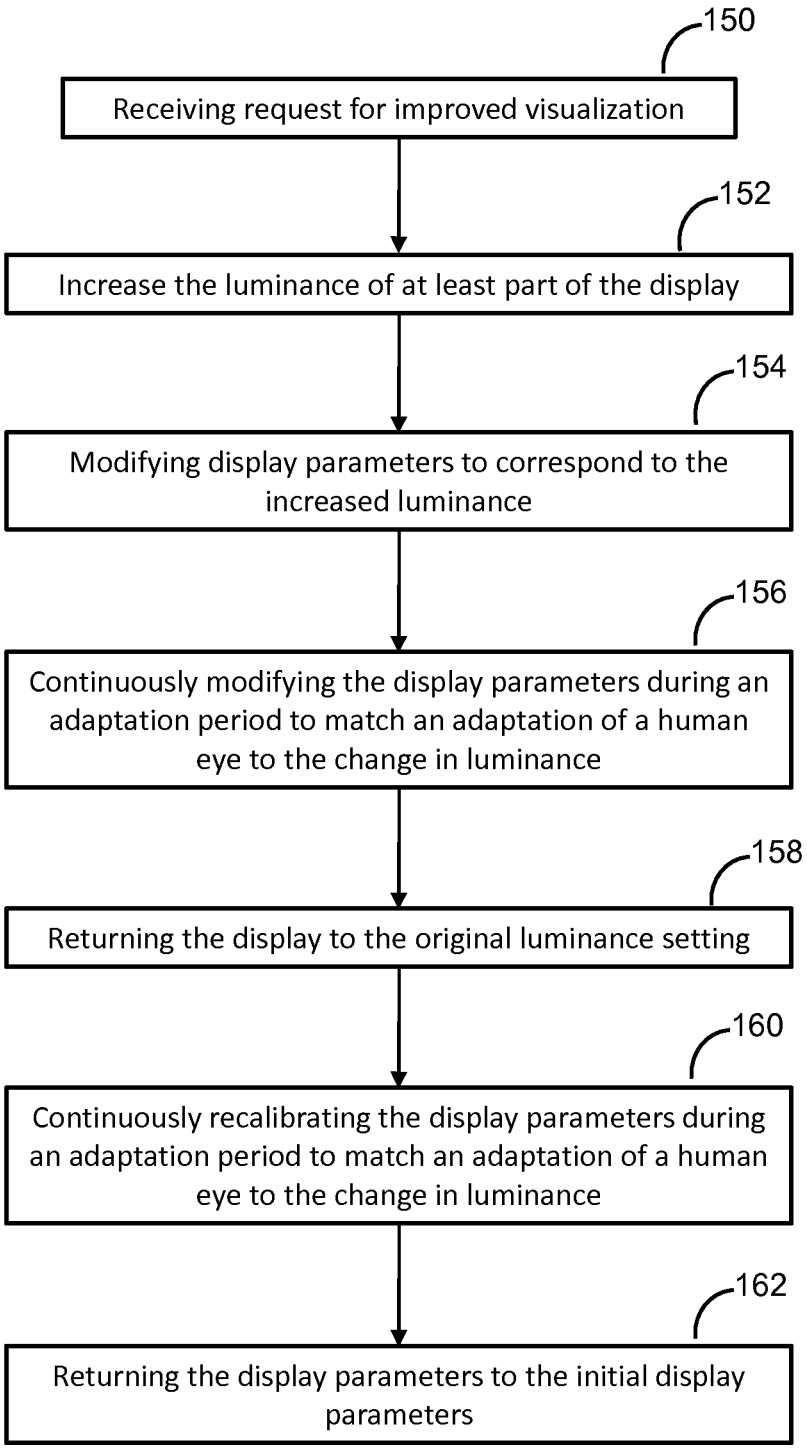
FIG. 6 is a flow chart illustrating a method according to the invention.

Turning next to FIG. 6, a flow chart illustrating a method of changing luminance of a display is provided. Flow commences at process block 150 wherein a request for improved visualization is received. The request for improved visualization may take any form, and may be a request for increased luminance. For example, the request may originate from a viewer pressing a button on the display. In addition, the request for improved visualization may be received via an on screen display viewer interface or by means of software, e.g., an application program interface call from image viewing software. It will also be understood by those of skill in the art that the request could originate from image processing software, such as software that applies an algorithm to the image and initiates a request for improved visualization based upon finding suspicious features.

Progression then continues to process block 152 wherein the luminance of at least part of the display is increased from a first luminance setting to a second luminance setting. The second luminance setting may be determined, for example, based on the maximum achievable luminance level of the display, a desired amount of increased detectability, the temperature of display elements prior to increasing the luminance, the ambient light level, the time required for the human eye to adapt to the change in luminance, or combinations thereof.

More specifically, it may be determined that the second luminance setting should provide 10% higher detectability. In such instance, the second luminance setting may be calculated based on the first luminance setting, the ambient light level, and the DICOM GSDF curve. Alternatively, it may be determined that the second luminance setting should achieve maximum detectability. In such case, the display may be driven to maximum luminance, considering that it should not exceed a threshold operating temperature. Alternatively, it may be determined that the second luminance setting should achieve maximum detectability without exceeding a predetermined adaptation time. In such case, the second luminance setting would be selected as the maximum luminance to which the viewer's could adjust within the predetermined adaptation time.

In addition, according to certain embodiments of the present invention, the display is a passive display, e.g., CCFL, LED, OLED, EL or a combination thereof, and includes at least one backlight, e.g., LED backlights. In such embodiments, increasing the luminance of the display may include increasing the luminance of the at least one backlight operating at the first luminance setting. In addition, increasing the luminance may also involve activating at least one additional backlight, such as additional LEDs. Moreover, increasing luminance may occur only over part of the display area. For example, the system may receive information identifying a target area of the display and increase the luminance of the display to a second luminance setting only over the identified target area.

Moreover, it may also be beneficial to maximize the video level of the display prior to increasing the luminance. For example, if the maximum video level of the display is 255 and the display is set to a lower level, such as 199, at the time the request for improved visualization is received, the video level may be increased (e.g., by way of contrast enhancement and adjusting other display parameters as will be understood by those skilled in the art) prior to increasing the luminance of the display. Thus, if a display shows an image that does not make use of the entire dynamic range that the display offers (e.g., the image sent to the display panel only contains gray levels 54 up to 220) then the image data can be modified such that the entire dynamic range of the display is used. This further improves visualization of the image.

Alternatively, the contrast enhancement may modify the image data such that the lowest video level in the image stays does not change (e.g., it stays video level 54) but that all other levels are rescaled such that the highest video level becomes the maximum video level that the display can handle (e.g., level 220 is mapped onto level 255 in case of an 8 bit display, and all original video levels with range 54-220 are mapped onto the range 54-255). The example given is only illustrative and the person skilled in the art will understand that various types of contrast enhancement, histogram mapping and gamut mapping algorithms can be used. In an alternative implementation, the modification of the image contents could also be done gradually instead of instantly in order to facilitate adaptation of the human eye. Moreover, both techniques may be combined. Thus it is possible and may be desirable to concurrently apply modification of the image data (to maximally make use of the available dynamic range of the display) while increasing the luminance and adapting corresponding display parameters (e.g., to ensure that the display remains DICOM GSDF compliant).

Flow then continues to process block 154 wherein additional display parameters are modified to correspond to the increase in luminance from the first luminance setting to the second luminance setting. Progression then continues to process block 156 wherein display parameters are continuously modified during an adaptation period to match an adaptation of a human eye to the change in luminance.

In one embodiment, the display settings are DICOM GSDF compliant at the first luminance setting, at the second luminance setting and during the adaptation period. In another embodiment, the display settings are adapted for a color display wherein modification during the adaptation period (e.g., color adaptation, color calibration, etc.) improves the viewer's perception of color images. Moreover, the display settings curve can be calculated based on a human visual system model, or determined by means of experiment.

It will also be understood by those skilled in the art that the present discussion references the grayscale DICOM GSDF standard, the invention is equally applicable to displays outputting color images. In such instances, the display parameters may be modified as known in the art to maintain proper color settings, as opposed to the grayscale and contrast display parameters discussed with reference to the DICOM GSDF standard.

The processes by which the display parameters may be modified to correspond to a change in luminance or the adaptation of the viewer's eyes are known in the art. Similarly, calculating the viewer's adaptation to a change in display parameters, such as luminance, is known in the art. For example, the adjustment model may take the form of look-up tables (LUTs), algorithms, or other models known to those skilled in the art. In addition, the modification of display parameters may occur at the refresh rate of the display to minimize visual artifacts. Discussions of such processes can be found in U.S. Publication No. 2010/0053222 entitled, "Methods and Systems for Display Source Light Management with Rate Change Control," filed Aug. 30, 2008; U.S. Publication No. 2006/0001641 entitled, "Method and Apparatus to Synchronize Backlight Intensity Changes with Image Luminance Changes," filed Jun. 30, 2004; U.S. Publication No. 2007/0067124 entitled, "Method and Device for Improved Display Standard Conformance," filed Jul. 28, 2006; U.S. Pat. No. 7,639,849 entitled, "Methods, Apparatus and Devices for Noise Reduction," filed May 23, 2005, the entirety of each of which is incorporated by reference herein.

In one embodiment, the display remains at the second luminance setting for a time period that may be defined, for example, from the point at which the luminance was originally increased, or from the point at which the human eye is fully adapted to the change in luminance. In addition, the system may also be capable of receiving a request (e.g., automated through software or initiated by the viewer) to maintain the display at the second luminance setting. Thus, a viewer of the display may be able to control the duration of operation at the second luminance. During operation at the second display setting, the system may also monitor the temperature of the backlight(s) and automatically return the display to the first luminance setting if the temperature exceeds an acceptable level.

In addition, the method of the present invention can be combined with other calibration/stabilization technology, such as ambient light compensation systems and methods. One such system is Barco Medical's I-Guard system. Thus, the ambient light compensation system may measure in real-time achieved luminance and (slightly) adapt the backlight driving value to maintain stable achieved luminance.

Progression then continues to process block 158 wherein the luminance is returned to the original luminance setting. The display parameters may be modified to correspond to the change. Flow then continues to process block 160 wherein display parameters are continuously modified during an adaptation period to match an adaptation of a human eye to the change in luminance from the second luminance setting to the first luminance setting. Flow then progresses to process block 162 wherein the display parameters match those of the initial display parameters prior to the change in luminance.

In one embodiment, the display is capable of more than two luminance settings. Thus, when the display is operating at the second luminance level, it may be capable of receiving an additional request for improved visualization. As will be understood by those skilled in the art, the process of adjusting the luminance and display parameters could then be repeated to change the luminance to a third setting that is higher than the second setting. In such instance the display would then eventually return from the third luminance setting to the first luminance setting.

Figure 7:
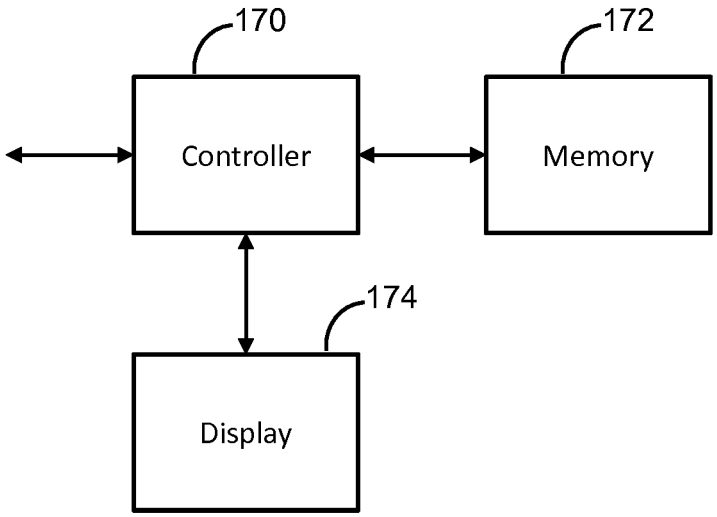
FIG. 7 is a block diagram illustrating a system according to the invention.

Turning next to FIG. 7, provided is a block diagram of a display system according to the invention. In its simplest form, the system includes a controller 170, memory 172 and a display 174. The controller 170 may configured to perform each of the functions identified in process blocks 150, 152, 154, 156, 158, 160 and 162. In doing so, the controller may access and store information, such as LUTs or data used for or derived from algorithms, in memory 172. The controller 170 may further cause the display 174 to operate using different display parameters or using various combinations of backlights.

It will be understood by those of skill in the art that the controller 170 may be any type of control circuit implemented as one or combinations of the following: as a hard-wired circuit; programmable circuit, integrated circuit, memory and i/o circuits, an application specific integrated circuit, application-specific standard product, microcontroller, complex programmable logic device, field programmable gate arrays, other programmable circuits, or the like. The memory 174 may be any type of storage as will be understood by those of skill in the art. Additionally, the display 176 may be any type of display, e.g., CRT, passive displays, such as LED, OLED, EL, CCFL, etc. Preferably, the display 176 is suitable for use as a medical diagnostic display.

In addition the functions and methodology described herein may be implemented in part or in whole as a firmware program loaded into non-volatile storage (for example, an array of storage elements such as flash RAM or ferroelectric memory) or a software program loaded from or into a data storage medium (for example, an array of storage elements such as a semiconductor or ferroelectric memory, or a magnetic or optical medium such as a disk) as machine-readable code, such code being instructions executable by an array of logic elements such as a microprocessor, embedded microcontroller, or other digital signal processing unit. Embodiments also include computer program products for executing any of the methods disclosed herein, and transmission of such a product over a communications network (e.g. a local area network, a wide area network, or the Internet). Thus, the present invention is not intended to be limited to the embodiments shown above but rather is to be accorded the widest scope consistent with the principles and novel features disclosed in any fashion herein.

It will be understood by those skilled in the art that the present invention, while primarily described in terms of medical displays, is applicable to other types of displays as well. For example, the methods and systems described herein may be particularly useful for satellite imaging. Satellite imaging data may have a very large dynamic range (e.g., 11+bits). Causing a satellite imaging display to operate at a second increased luminance setting may be useful to assist the viewer in resolving detail in the display images.

Although the invention has been shown and described with respect to a certain preferred embodiment or embodiments, it is obvious that equivalent alterations and modifications will occur to others skilled in the art upon the reading and understanding of this specification and the drawings. In particular, in regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent). In addition, while a particular feature of the invention may have been described above with respect to only one or more of several illustrated embodiments, such feature may be combined with one or more other features of the other embodiments, as may be desired and advantageous for any given or particular application.

The invention claimed is:

1. A method for improving visualization in an image display:

operating the display at a first luminance setting;

receiving a request for improved visualization;

modifying the luminance of the display to cause the display to operate at a second luminance setting that is higher than the first luminance setting; and returning the display to the first luminance setting;

wherein the calibration parameters of the display are adapted such that the display complies to a standard when the display operates at the first luminance setting, while the display is gradually transitioning from the first luminance setting to the second luminance setting, and while the display operates at the second luminance setting.

2. The method of claim 1, wherein at least one of the modification of the luminance to cause the display to operate at the second luminance setting or the modification of the luminance to cause the display to return to the first luminance setting comprises a gradual change in luminance.

3. The method of claim 1, wherein the return of the display to the first luminance is triggered by at least one of: an elapsed period of time, an increase in temperature that exceeds an absolute or relative threshold, the receipt of an explicit instruction that operation at the second luminance setting is no longer needed, or the cessation of an indicator that the display should continue to operate at the second luminance setting.

4. A method of claim 1, wherein the display parameters are modified to correspond to the increased luminance such that the perceived contrast between adjacent levels at the second luminance setting is greater than the perceived contrast between adjacent levels at the first luminance setting, and wherein the display parameters are modified during an adaptation period of the luminance increase to match an adaptation of a human eye to the change in luminance from the first luminance setting to the second luminance setting.

5. The method of claim 1, further comprising:

modifying the display parameters during an adaptation period to match an adaptation of a human eye to the change in luminance from the second luminance setting to the first luminance setting; and returning the display parameters to the initial display parameters.

6. The method of claim 1, wherein the display settings are DICOM GSDF compliant at the first luminance setting, at the second luminance setting and during the adaptation period.

7. The method of claim 1, further comprising maximizing the video level of the display upon a request for improved visualization and prior to increasing the luminance of the display.

8. The method of claim 1, wherein modifying the display parameters is performed according to an algorithm, a LUT or other any known model suitable for compensating for a change in luminance.

9. The method of claim 1, further comprising receiving a request to maintain the display at the second luminance setting.

10. The method of claim 1, wherein the display comprises at least one backlight and further comprising monitoring the temperature of the at least one backlight while the display is operating at the second luminance setting.

11. The method of claim 1, wherein the second luminance setting is determined based on at least one of: the type of image being viewed, the type of task to be performed by the viewer, the currently maximum achievable luminance of the display, the maximum achievable luminance level of the display, the remaining expected lifetime of the display, the desired amount of increased detectability, the temperature of display elements prior to increasing the luminance, the ambient light level, or the time required for the human eye to adapt to the change in luminance.

12. The method of claim 1, further comprising:

receiving a request for improved visualization of the display operating at a second luminance setting with modified display parameters;

increasing the luminance of at least part of the display from the second luminance setting to a third luminance setting;

modifying the display parameters to correspond to the increased luminance such that the difference in luminance between adjacent levels at the third luminance setting is greater than the difference in luminance between adjacent levels at the second luminance setting; and modifying the display parameters during an adaptation period to match an adaptation of a human eye to the change in luminance from the second luminance setting to the third luminance setting.

13. The method of claim 1, wherein the display comprises multiple backlights, and wherein increasing the luminance of the display comprises at least one of: increasing the luminance of at least one backlight operating at the first luminance setting, or activating at least one additional backlight.

14. The method of claim 1, further comprising receiving information identifying a target area of the display and increasing the luminance of the display to a second luminance setting only over the identified target area.

15. The method of claim 1, wherein modifying the display parameters occurs at the refresh rate of the display.

16. A method for controlling a medical display or a satellite imaging display using the method of claim 1.

17. A medical image display system comprising:

a display;

an image processing controller communicably coupled to the display; and memory communicably coupled to the image processing controller;

wherein the image processing controller is configured to operate the display in accordance with the method of claim 1.

* * * * *